United States Patent [19]

Blanc

[11] 4,143,474

[45] Mar. 13, 1979

[54] SKIBOOT

[75] Inventor: Roger Blanc, Izeau, France

[73] Assignee: Garmont S.p.A., Volpago del Montello (Treviso), Italy

[21] Appl. No.: 882,628

[22] Filed: Mar. 2, 1978

[30] Foreign Application Priority Data

Mar. 4, 1977 [FR] France ..... 77 07235

[51] Int. Cl.[2] ..... A43B 5/04; A43B 23/26

[52] U.S. Cl. ..... 36/120; 36/54

[58] Field of Search ..... 36/117, 118, 119, 120, 36/121, 50, 54

[56] References Cited

U.S. PATENT DOCUMENTS

| | | | |
|---|---|---|---|
| 3,783,534 | 1/1974 | Phillips et al. | 36/54 |
| 4,008,532 | 2/1977 | Kilbourn et al. | 36/120 |

FOREIGN PATENT DOCUMENTS

| | | | |
|---|---|---|---|
| 1520286 | 2/1968 | France | 36/54 |

*Primary Examiner*—Patrick D. Lawson
*Attorney, Agent, or Firm*—Karl F. Ross

[57] ABSTRACT

A skiboot has a one-piece vamp secured to the sole of the boot and having a closed toe portion and an upwardly and backwardly opened heel portion. A one-piece forwardly U-shaped rear upper part is pivoted on the vamp at the heel portion thereof and has flaps which lie ahead of the pivots. A tongue is secured to and extends upwardly from the vamp inside the rear upper part between the flaps thereof and has above these flaps a forwardly projecting shoulder. A closure is carried on these flaps for securing them together in front of the tongue underneath the shoulder. The rear part is pivoted back for putting on or taking off the boot, but in use is pivoted forwardly and held in place under the shoulder of the tongue with the closure of the boot tightening the rear part about the ankle of the user.

10 Claims, 4 Drawing Figures

SKIBOOT

FIELD OF THE INVENTION

The present invention relates to a skiboot.

BACKGROUND OF THE INVENTION

A skiboot is a heavy duty piece of footwear which must fulfill various rather stringent requirements. First of all it must snugly encase the foot and lower ankle of the wearer so as to prevent the most common type of skiing injury; a sprained or broken ankle or twisted ankle joint. At the same time it must give the user sufficient freedom of motion that he or she can maneuver while skiing. Finally a skiboot must be relatively easy to put on and remove as the boot is normally not comfortable for walking and the user is frequently wearing heavy gloves or mittens when putting it on or taking it off.

A common type of skiboot comprises synthetic-resin upper whose top is open from immediately adjacent the toes all the way up to the collar of the boot. A row of boot closures is provided along this opening which serve both to close the shoe part over the foot and to tighten the ankle part around the ankle.

Such a skiboot has the considerable disadvantage that the closures invariably exert a backward force on the foot of the wearer. Thus if tightened the foot of the wearer is pushed to the back of the boot. Thus the skier typically tightens the closures on top of the foot considerably more than the closures at the front of the ankle in order to hold the foot down in the middle of the boot. This fastening method is relatively uncomfortable and does not assure a proper positioning of the foot within the boot.

OBJECTS OF THE INVENTION

It is therefore an object of the present invention to provide an improved skiboot.

Another object of this invention is to provide such a boot which can easily be fastened and unfastened, even by a user wearing mittens or heavy gloves.

A further object of this invention is the provision of the skiboot wherein the skier's foot will automatically be properly positioned inside the boot.

SUMMARY OF THE INVENTION

These objects are attained according to the instant invention in a skiboot wherein a vamp is secured to the sole of the boot and has a closed toe position and an upwardly and backwardly open heel portion. A rear upper part is provided on the heel portion of the vamp and has a pair of forwardly projecting flaps. This rear upper part is supported at the heel portion of the vamp and behind its flaps at a pair of coaxial horizontal pivots. A tongue secured to and extending upwardly from the vamp lies inside the rear upper part between the flaps thereof and has above these flaps a forwardly projecting shoulder. Finally a closure is provided between the flaps for securing them together in front of the tongue and underneath the shoulder thereof.

According to the present invention the pivot axes are provided below the ankle bones of the skier so that it is possible to tip the upper part back relatively far, indeed far enough to allow the foot of the user to slip into the vamp almost completely from in back. Once inside the boot it is possible to tip this rear portion forward and snugly enclose the ankle of the user with exact positioning of his or her foot in the skiboot. When the skier bends forward it is possible for this upper part to flex somewhat forwardly to follow his or her movements, but when displaced backwardly, as is normally done to lift the tip of the ski, the shoulder on the tongue of the skiboot will hold the upper part in place and allows such lifting of the ski tip. This flexing forwardly and backwardly is further facilitated by forming the upper edge of the vamp which defines the foot-receiving opening thereof at its farthermost forward portion with an upwardly opening cutout. The tongue of the skiboot is secured to the vamp to either side of this cutout by means of rivets. Thus the skiboot according to the instant invention allows mobility and flexion of the foot and ankle in those directions necessary for proper skiing, but at the same time holds the foot comfortably on the ski and prevents flexion to the side.

The two main parts of the skiboot according to the invention—the vamp connected permanently to the sole and the rear upper part pivoted on the vamp—are each formed by blow molding. As a result the boot can be made relatively light and therefore very comfortable. Each of these parts is formed of a single unitary piece, and the interior of the boot is proivded with the customary padding, in particular inside the tongue. What is more such a boot is provided in accordance with standard procedures with a separate slipper-type lining.

SPECIFIC DESCRIPTION

As shown in FIGS. 1–4 a skiboot according to this invention basically comprises a blow-molded vamp 1, a sole 2 permanently secured underneath the vamp 1, a tongue 3 extending upwardly from the vamp 1, and a blow-molded back or rear upper part 4 pivoted on the vamp 1. The sole 2 may be unitarily cast with the vamp 1 and is shaped so as to fit in a conventional ski binding.

Figure 3:
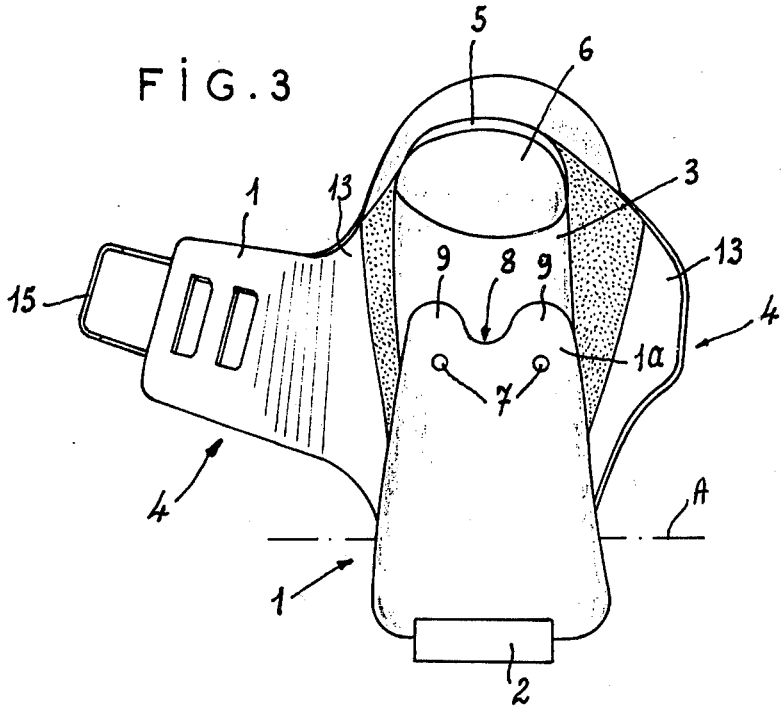
FIG. 3 is a view taken in the direction III of FIG. 2.

The vamp 1 is upwardly closed as shown in FIG. 3 and has a toe part 1*a* and a heel part 1*b*. The height h between the sole and the upper edge 1*c* at the region 1*b* is between 2 cm and 4 cm. Ahead of the edge 1*c* the vamp 1 has an upper edge 1*d* which rises upwardly to a height H above the sole equal to approximately half of the overall height of the boot. The edge 1*c* has a horizontal dimension equal to between 5 cm and 8 cm, depending on the size of the foot the boot is made to fit.

The tongue 3 is internally padded in a manner well known in the art as shown at 5, and is here formed at the front with a raised portion 6 forming a horizontal shoulder 6*a*. This tongue 3 is secured to the vamp 1 as shown in FIG. 3 by a pair of laterally spaced rivets 9 flanking a cutout 8 formed in the upper edge 1*d* at the frontmost portion thereof between a pair of tabs 9. This cutout 8 allows the foot of the wearer of the boot to move forwardly without binding on the edge 1*c* in a manner frequently necessary during skiing.

Figure 4:
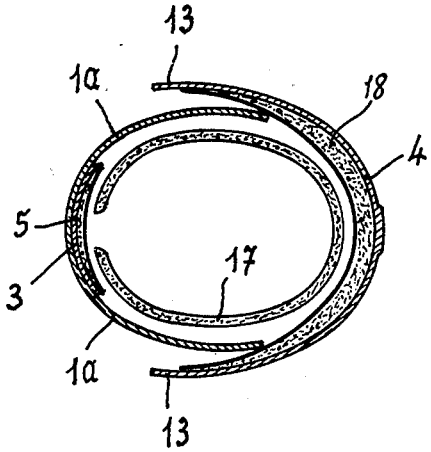
FIG. 4 is a section along line IV—IV of FIG. 2.

The rear part 4 is forwardly U-shaped as seen in FIG. 4 and has internal padding 18. The back part 12 of the rear part 4 is shaped exactly to fit the rear part of the foot and ankle of the wearer. The rear part 4 has on each side of the vamp 1 a lower edge portion 10 secured by means of a pivot pin 16 to the rear part 1*b* of the vamp 1 below the ankle bone of the wearer for pivoting of this rear part 4 about an axis A extending transversely to the longitudinal direction of the shoe, spaced less than 4 cm above the sole 2, and lying within 8 cm of the rearmost part of the vamp 1.

Finally the rear part 4 has a pair of forwardly extending flaps 13 one of which is extended at 11 so that it can be wrapped around the front of the boot underneath the shoulder 6*a*. A clip 14 secured to one of the flaps 13 cooperates with a buckle 15 carried on the extension 11 of the other flap 13 for closing of the boot.

Under normal circumstances the boot is provided with a conventional slipper-type lining 17 which may be of the molded-in-place-type to assure best fit.

Figure 1:
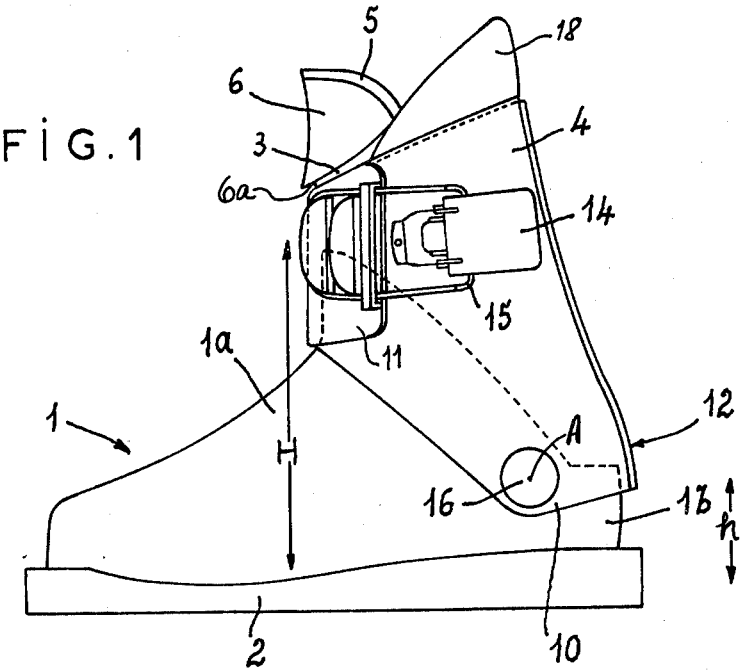
FIGS. 1 and 2 are side views of the boot according to this invention in the closed and open positions, respectively.
Figure 2:
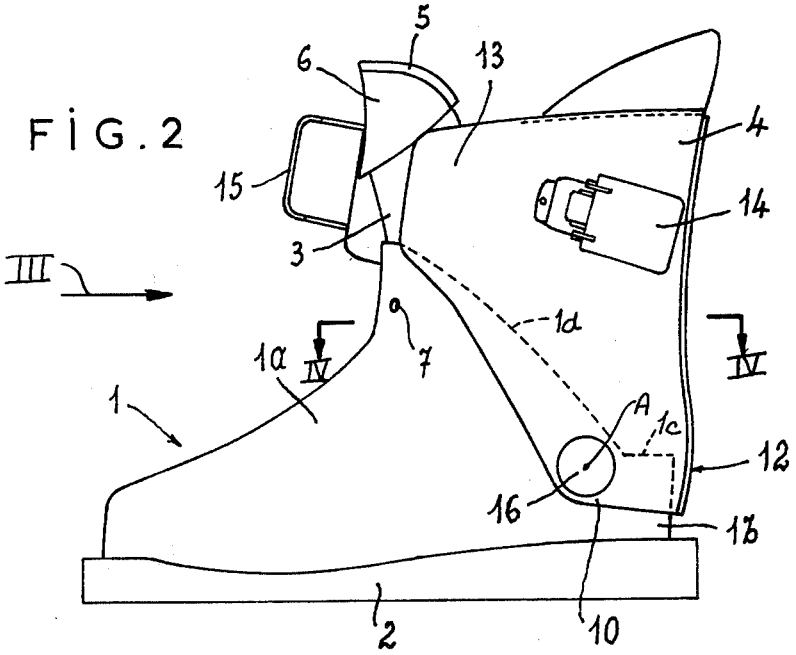

In order to don the boot the closure constituted by the buckle 15 and clip 14 is opened and the rear part 4 is pivoted backwardly into the position of FIG. 2. The user can then easily insert his or her foot down into the boot and into the vamp 1. The rear part 4 is then pivoted forwardly so that the padding 18 comes to lie snugly against the rear part of the ankle, positioning the foot in the center of the boot for maximum comfort. The extension 11 of the one flap 13 is then pulled around underneath the shoulder 6*a* and the buckle 15 and clip 14 are locked together to snugly encase the ankle of the user as shown in FIG. 1. Thus a single closure is used on the boot, and is of the type which can be adjusted once for the individual requirements of the user and thereafter merely snapped open and closed.

In use the foot of the user is snugly held in the one-piece vamp 1, the ankle is firmly encased in the upper part 4 but is prevented from pivoting backwardly when the boot is closed as shown in FIG. 1 by shoulder 6*a* which extends over the flap 13. The pivot 16 therefore serves mainly for opening of the boot as shown in FIG. 2 to put it on and take it off, and for limited pivoting forwardly and backwardly during use. The snug fit between the upper part 4 engaging down around the upper edge 1*c* and 1*d* of the vamp 1 also ensures that the boot will be quite warm and that entry of snow into it will almost be impossible.

I claim:

1. A skiboot comprising:

a sole adapted to underlie a foot;

a vamp secured on said sole and having a closed toe portion and an upwardly and backwardly open heel portion;

a rear upper part on said heel portion and having a pair of forwardly projecting flaps;

a pivot between said rear upper part and said vamp at said heel portion of said vamp and behind said flaps of said rear upper part;

a tongue secured to and extending upwardly from said vamp inside said rear upper part between said flaps thereof and having above said flaps a forwardly projecting shoulder; and a closure between said flaps for securing same together in front of said tongue and underneath said shoulder thereof.

2. The skiboot defined in claim 1 wherein said vamp is upwardly closed in front of said tongue.

3. The skiboot defined in claim 2 wherein said vamp has an extreme rear end with a height above said sole of at most 4 cm.

4. The skiboot defined in claim 2 wherein said vamp has an upper edge defining a foot-receiving opening at said heel portion and formed at its frontmost portion with an upwardly opening cutout, said tongue being secured to said vamp to either side of said cutout.

5. The skiboot defined in claim 4, further comprising a rivet to each side of said cutout securing said tongue to said vamp.

6. The skiboot defined in claim 2 wherein said vamp is one piece and said upper part is one piece.

7. The skiboot defined in claim 2 wherein said upper part is forwardly U-shaped seen from above.

8. The skiboot defined in claim 2 wherein said upper part is displaceable about said pivots on said vamp between an open position tipped back away from said vamp and allowing a foot to be inserted into said vamp, and a closed position tipped forwardly on said vamp and snugly gripping around an ankle of a foot in said vamp.

9. The skiboot defined in claim 2 wherein said vamp is rigid.

10. The skiboot defined in claim 2 wherein one of said flaps is extended and can be wrapped around the other of said flaps.

* * * * *